US005140872A

United States Patent [19]

Holliday et al.

[11] Patent Number: 5,140,872

[45] Date of Patent: Aug. 25, 1992

[54] STEEL RULE DIE AND METHOD

[75] Inventors: George L. Holliday; Brightman K. Holliday; Herbert G. Shimer, Jr., all of Greensboro, N.C.

[73] Assignee: Ameritek, Inc., Greensboro, N.C.

[21] Appl. No.: 201,322

[22] Filed: May 25, 1988

Related U.S. Application Data

[63] Continuation of Ser. No. 701,659, Feb. 15, 1985, abandoned, which is a continuation of Ser. No. 567,942, Jan. 4, 1984, abandoned, which is a continuation-in-part of Ser. No. 299,672, Sep. 8, 1981, abandoned.

[51] Int. Cl.[5] ..... B26D 7/00

[52] U.S. Cl. ..... 76/107.8; 493/73; 493/354; 219/121.67; 219/121.68; 83/16

[58] Field of Search ..... 219/121.67, 121.68, 219/121.69; 493/61, 73, 354, 372; 83/16, 171, 177; 76/107.1, 107.8

[56] References Cited

U.S. PATENT DOCUMENTS

| | | | |
|---|---|---|---|
| 3,283,617 | 11/1966 | Kletzker | 493/354 |
| 3,383,969 | 5/1968 | Saunders | 76/107 C |
| 3,396,620 | 8/1968 | Rophael et al. | 76/107 C |
| 3,749,878 | 7/1973 | Sullivan et al. | 219/121.67 |
| 3,786,732 | 1/1974 | Forbes, Jr. | 493/354 |
| 3,805,657 | 4/1974 | Simpson | 76/107 C |
| 3,863,550 | 2/1975 | Sarka et al. | 76/107 C |
| 3,937,109 | 2/1976 | Korner et al. | 76/107 C |
| 3,941,038 | 3/1976 | Bishop | 76/107 C |
| 4,052,886 | 10/1977 | Buick | 76/107 C |
| 4,112,827 | 9/1978 | Kong | 76/107 C |
| 4,125,757 | 11/1978 | Ross | 219/121.67 |
| 4,201,905 | 5/1980 | Clark et al. | 219/121.67 |
| 4,248,117 | 2/1981 | Bugnone | 76/107 C |
| 4,249,432 | 2/1981 | Graboyes et al. | 76/107 C |
| 4,332,999 | 6/1982 | Wittke | 219/121.67 |
| 4,336,439 | 6/1982 | Sasnett | 219/121.67 |

OTHER PUBLICATIONS

"Tool Engineers Handbook", ASTE Handbook Committee, First Edition, 1949, pp. 1078, 1080, 1081, 1088, 1089, 1094.

S. S. Charschan, "Lasers in Industry", Aug. 6, 1973, pp. 281-285.

Bod et al., "A Powerful $CO_2$ Cutting Tool", L. F., Aug. 1969, pp. 36 & 37.

*Primary Examiner*—David Jones

[57] ABSTRACT

A steel rule die set and method for cutting and scoring sheet material in which the male cutting and scoring die has a steel rule with knife and scoring edges secured firmly in a metal face plate having retaining laser cut openings and a complementary female counter plate having a metal plate with laser cut score lines in juxtaposition to the steel rule score edges.

9 Claims, 2 Drawing Sheets

STEEL RULE DIE AND METHOD

This application is a continuation of application Ser. No. 701,659, filed Feb. 15, 1985, which is a continuation of application Ser. No. 567,942, filed Jan. 4, 1984, which is a continuation-in-part of application Ser. No. 299,672, filed Sep. 8, 1981, all now abandoned.

BACKGROUND AND OBJECTIVES OF THE INVENTION

Steel rule dies for cutting and scoring as well as embossing sheets of cardboard and flexible materials have been fabricated from wood, laminated wood, resinated and impregnated woods, and metal "furniture" in which the steel rule cutting knives and scoring rules have been fitted into slots cut into the die body of the wood or metal and held in position by various means including the introduction of plastic materials such as epoxy resins into slots or cavernous openings in the die base to anchor securely the cutting rules and scoring rules from displacement. The semi-rigid or rigid plastic materials that have been employed as well as other rule retaining means have been time consuming to fabricate and costly to build The life of steel rule dies that have been encavitated for supporting the steel rules by introducing plastic materials to support the rules to formulate a solid base material have not been commercially successful.

The reusable counterplates for cutting and scoring boxhoard or paper board to form carton blanks must be accurately constructed for reuse on hundreds of thousands or millions of impressions and cuttings necessitating precision fabrication and highly durable materials for retaining the cutting and scoring plates or rules in position in their slots within the base or supporting die member.

The female counter plate for receiving the cutting and scoring rules must be accurately fabricated to receive the cutting and scoring rules to avoid misalignment and resulting inferior cutting and scoring of the final product.

One of the primary problems with steel rule scoring dies has been the fabrication of the female counter in which the time consuming process of chemical etching has been utilized which has been extremely costly and time consuming. Computer controlled milling of the counter plate has also been costly and time consuming.

It is an objective of the present invention to provide a steel rule scoring die and counter plate in which the steel rule cutting and scoring rules may be very accurately positioned and retained in the male die, and the female counter plate may be accurately matched with the requisite shallow slots into which the scoring rules are operatively inserted to provide the requisite score lines in the work material to reduce to a minimum torn or severed slots in the workpiece.

A further objective of this invention is to provide a steel rule die set for cutting and scoring material which has a metal face plate from which steel cutting and scoring rules are imbedded and project from the metal face plate and are retained therein by precisely cut openings for retention without extraneous plastic materials enabling the steel cutting and scoring members to cooperate with a female metal counterplate in which laser cut complementary score line openings are provided to cooperatively receive the score members of the male die with the counter plate having secured thereto a back-up plate covering the score line openings.

Yet another objective of this invention is to provide a female counterplate having a metal face with laser cut complementary score line openings that are precisely aligned with the steel rule scoring members.

SUMMARY OF THE INVENTION

The present invention overcomes the problems of the prior art by providing a steel rule die set and method for cutting and scoring sheet material having accurate means for aligning male and female embossing members attached to the male die and in which cutting rules and scoring rules are inserted in the die through slots that are formed by laser precision cutting. Although the use of laser beams has been proposed for forming the grooves in plywood as noted in U. S. Pat. 3,863,550, it has not been found to be acceptable in its utilization since the grooves formed are inaccurate and the steel rule is relatively loosely held within the groove necessitating suitable filler material such as an epoxy resin or other thermoplastic or thermosetting resin material that is capable of being cured into a semi-rigid structure may be utilized to support the steel rule cutting and scoring members.

The laser beam cutting of the present invention for piercing the metal face plate and counter plate of the die set is very accurately controlled with the proper axial gas flow jet at preselected pressures and pulse rates to form precision slotted openings for receiving and retaining the steel cutting and scoring members in position and to cut the scoring slots in the female counter plate eliminating the necessity for utilization of any plastic or other supporting structure within the slot adjacent to the steel rule.

The slots formed in the counter plate may be accurately controlled within the precision necessary for the highest quality cutting and scoring die but at a fraction of the time and cost.

The male cutting and scoring die metal face plate is provided with a die base and backing member which may be made of Permaplex or any other suitable rigid material that will support the bases of the steel rule cutting and scoring members.

Other objectives and many of the advantages of this invention will become more readily apparent to those skilled in the art of steel rule die sets from the following detailed description and the accompanying claims which are not intended to be limited to the specific embodiment and modifications and equivalents are contemplated.

DESCRIPTION OF PREFERRED EMBODIMENT

Figure 1:
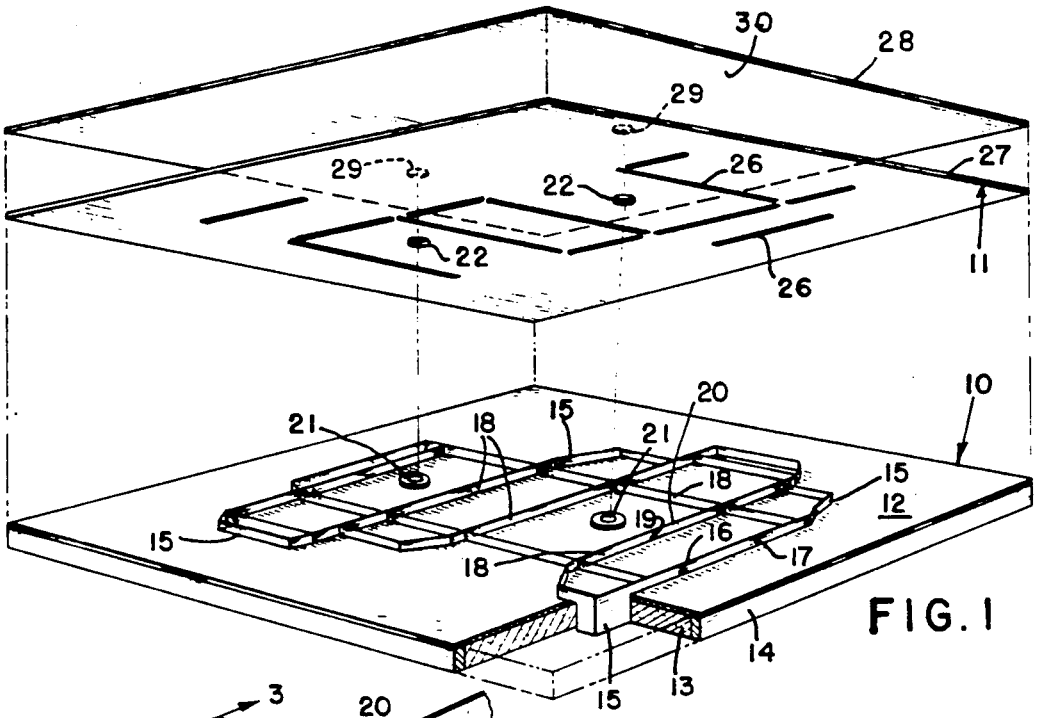
FIG. 1 is an exploded perspective view with a section removed of a steel rule die assembly embodying the invention with the components in the male die in position and the counter plate components spaced apart.

Referring to the drawing and particularly to FIG. 1, there is illustrated a steel rule die set formed of the male die 10 and the female counter plate 11 shown in vertically spaced relationship to each other. The male die has a stainless steel metal face plate 12 preferably fabricated of 410 stainless steel which is hardened sufficiently to withstand substantial wear and abrasion. The face plate 12 has secured to its back a backing plate 13 which may be of a dense material of resinated board or Permaplex and is sufficiently dense and of high density to resist disintegration under repeated cycles of pressure loadings. A metal framework 14 provides a perimeter around the male die forming a side rail and is firmly secured to the bottom of plate 12 and the edge of the backing 13. A steel cutting rule section 15 is imbedded in the backing 13 and extends or protrudes vertically above the metal face plate 12 with the top edge 16 of the steel cutting rule 15 being sharpened to provide the requisite cutting edge for the material to be cut. A relatively short segment 17 of the rule 15 extends upwardly and is exposed above the face of plate 12.

The steel scoring rule 18 is also provided with a short segment 19 that extends above the surface of plate 12 with the main portion extending downwardly through the plate 12 and into the backing 13 in a manner similar to the portion 14 of the cutting rule 15. The upper edge 20 of the scoring rule 18 has a suitable radius or curvature to form a scoring line in the sheet material to be scored to form a fold line. Die positioning and mating buttons 21 are securely mounted in the plate 12 to cooperatively receive the button locating openings 22 in the female counterplate 11.

The particular contour lines formed by the steel cutting rules 15 essentially form the perimeter of the pattern of the particular carton or box to be cut. The steel scoring rules 18 within the perimeter of the cutting rules 15 will form the scoring for the fold lines of the carton formed by the sheet material.

Figure 2:
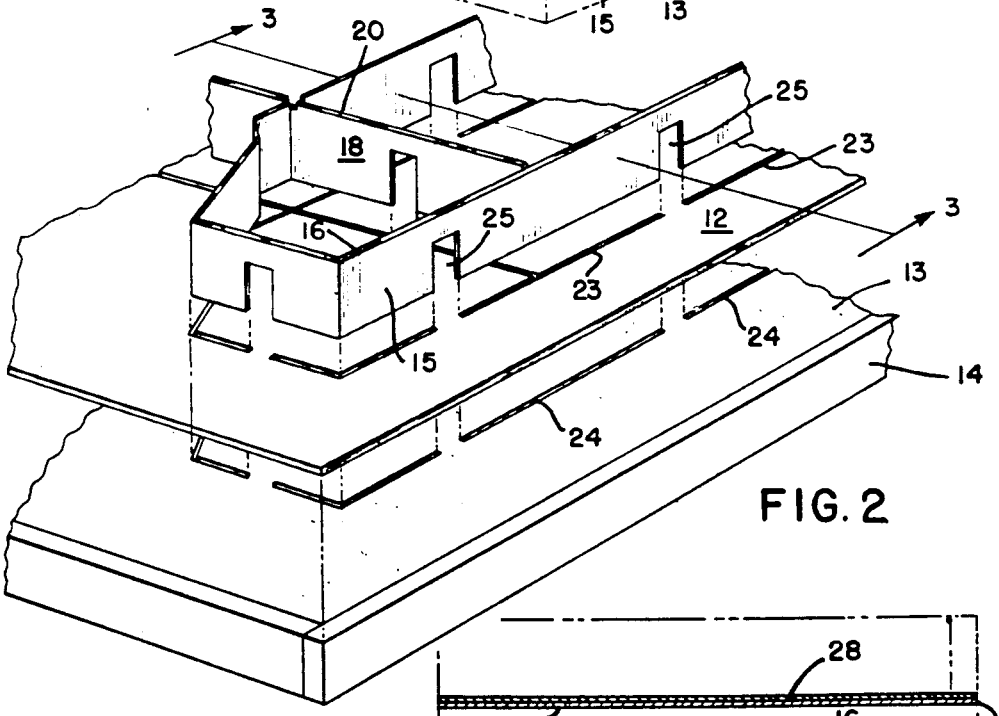
FIG. 2 is an enlarged exploded perspective view of a portion of the male die with only portions illustrated in juxtaposition before assembly.

The metal face plate 12 as shown in FIG. 2 is provided with a series of elongated rule-receiving slots which pass through the steel metal face plate 12 with only sufficient clearance to receive securely therethrough the cutting and scoring rules 15 and 18 with a minimum of clearance. Similar elongated rule-receiving slots 24 are formed in the backing member 13 for retaining the lower sections of the cutting and scoring rules 15 and 18 in a manner as shown in FIG. 1. The individual sections of the cutting and scoring rules are provided with U-shaped recesses 25 at spaced intervals for optimum rule flexibility and bending while relieving high stresses which may be present in the rules.

The back of the metal face plate 12 and the upper surface of the backing plate 13 are secured together by a suitable adhesive to prevent parting of these members.

The female counter plate 11 is also preferably constructed of 410 stainless steel which has the requisite hardness for maximum life through repeated cycles of cutting and scoring. The counter plate 11 has a series of cooperating score line slots 26 therein which will cooperate with and receive therein the upper score edge 20 of the scoring rules 18 during each cycle of the press for each carton to be cut and scored.

The female counter plate 11 has securely fastened to its reverse side a rigid backing plate 28 in which the positioning openings 29 are provided to coincide with the openings 22. The backing plate 28 is preferably fabricated of 410 stainless steel similar to the counter plate 11 and the backing plate is securely fastened by suitable adhesive to the back side 27 of counter plate 11. The smooth undersurface 30 of the backing plate will serve to cover the slotted score openings 26 in the counter plate 11 thereby serving as an anvil for the scoring rules 18 which force the sheet material into the slotted score lines 26 of the female counter plate.

Figure 3:
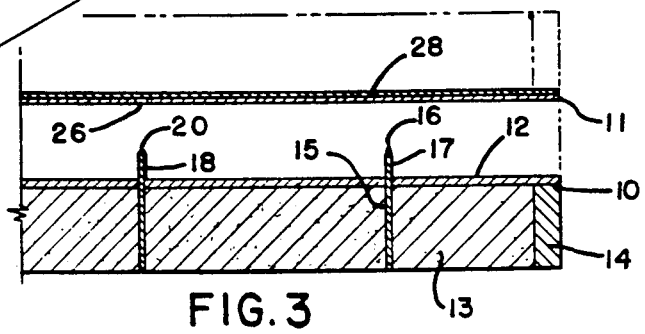
FIG. 3 is a partial transverse sectional view taken substantially along Line 3—3 of FIG. 2 with the counter plate in elevated spaced relation to the male die.

As illustrated in FIG. 3, the male die 10 is positioned beneath the counter plate 11 or the positioning may be reversed with the counter plate 11 on the face of the press with the male die above for reciprocation. The cutting rule 15 is imbedded in the backing plate 13 and the metal face plate 12 and projects upwardly a short distance above the level of the scoring rule 18 which is also firmly imbedded in the base 13 and extends through the metal face plate 12. The upper edge 20 of the scoring rule 18 is directly in line with the slot 26 in the counter plate 11 so that the sheet material inserted between the male cutting and scoring plate and the female counter plate may be cut by the steel cutting rule 15 through the cutting edge 16 when forced against the smooth surface of the counter plate while the sheet material is scored by the rounded edge 20 of the scoring rule 18 by insertion of the rounded edge 20 into the opening 26 in the counter plate.

The cutting and scoring rule-receiving elongated slots 23, 24 and 26 are precision cut by means of a laser beam under critically controlled conditions to cut specifically the stainless steel sheets. A $CO_2$ laser apparatus of the type manufactured and sold by Coherent, Inc. of Palo Alto, Calif., Model Nos. 150 and 325 have been utilized in which there is a 250–300 micro-second pulse width at a rate of 770–2000 pulses per second with a feed rate of 0.250–0.666 inches per second with an average peak power of 30–100 watts using an axial flow of jet gas with oxygen at 15–65 psi pressure. A 2.5 inch focal lens is employed at 10.6 micron wave length through a 0.020 to 0.040 orifice in a brass nozzle with the focal point at the surface of the metal. The surface area being cut is maintained parallel to the cutting nozzle with 0.001 to 0.003 slots being cut in the plate ultimately to form a slot ranging from 0.010 to 0.10 inches in width. The cutting of the slots 24 in the matrix packing plate or Permaplex packing does not require the aforementioned laser specifications and may be laser cut under conventional standards.

The longitudinal slots 23 and 26 require no final finishing such as grinding or milling after having been laser beam cut to the precise tolerances necessary for a tight fit with the cutting and scoring rule 15 and 18.

The laser beam cut slots 26 in the counter plate are also clear of any slag or ridge eliminating the necessity for any milling or grinding.

The assembly of the cutting and scoring rules 15 and 18 may be inserted in a conventional manner after formation of the pattern. The laser beam cuts in the stainless steel sheets which average the thickness of from 0.062 to 0.125 inches.

Figure 4:
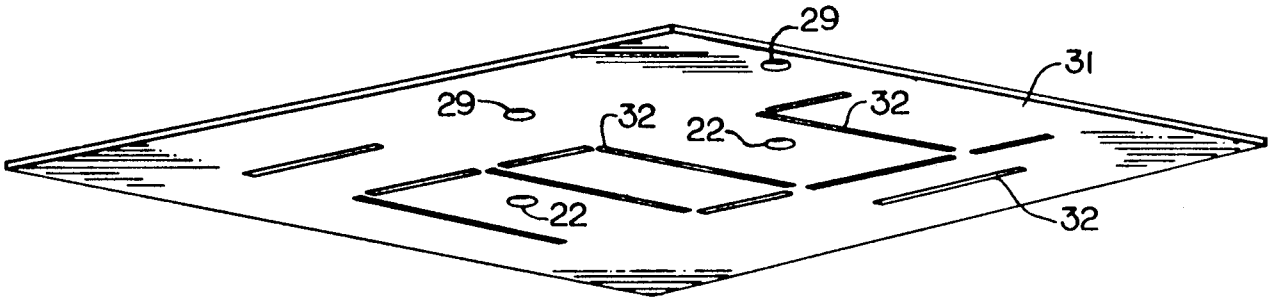
FIG. 4 is a perspective view of a modified female counter plate similar to that shown in FIG. 1.
Figure 5:
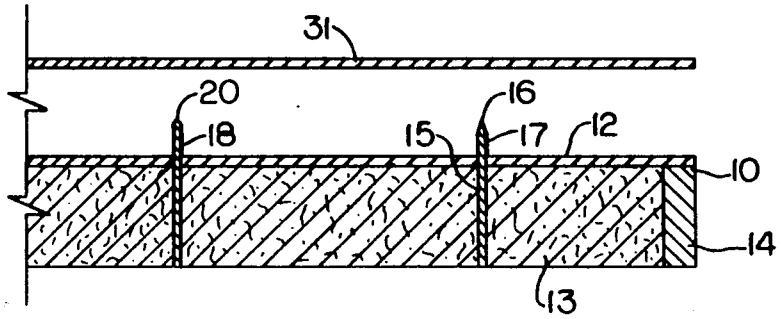
FIG. 5 is a view similar to FIG. 3 with the modified counter plate of FIG. 4.

An improved female counterplate 31, as shown in FIG. 4, may be employed which has been laser beam scribed to eliminate the necessity for a rigid backing plate 28 shown in FIGS. 1 and 3. The female counterplate 30 is constructed of high carbon tool steel in which the laser scribed longitudinal slots 32 are 25 percent to 50 percent of the plate thickness.

In one specific example, a high carbon tool steel plate is used having a thickness of 0.062 inches and has been scribed to a depth of 0.014 inches to 0.031 inches. A Laser Coherent Model No. 325$CO_2$ industrial laser has been employed in which the laser frequency is 255 pulses per second with a pulse length of one (1) millisecond at 90 to 120 watts peak average power. An axial flow jet stream of oxygen is utilized at a pressure of 15 pounds per square inch and at a 2.5 inch focal lens at 10.6 micron wave length.

We claim:

1. In combination, a steel rule male cutting and scoring die and a female counter plate comprising; a male metal face plate, said metal face plate having a series of laser beam cut steel rule elongated precision slots, steel rule cutting and scoring members securely retained in said laser beam cut elongated precision slots corresponding to a predetermined pattern of sheet material to be die cut and scored, a female counter plate positioned and aligned to cooperate with said male metal face plate and steel rule cutting and scoring members, said female counter plate having a metal plate, said metal counter plate having a series of laser beam cut elongated precision slots cooperatively to receive the steel rule edge scoring members retained on said male metal face plate, and a counter back-up plate secured to said female counter plate to blank said laser beam elongated slots for receiving the steel rule scoring members and sheet materials to be scored in said elongated slots in said female counter plate.

2. In combination, a steel rule male cutting and scoring die and a female counter plate as claimed in claim 1, a backing member for said male metal face plate having laser beam cut steel rule elongated precision slots for cooperatively retaining the steel rule cutting and scoring members therein with said slots in said male metal face plate and said backing plate being aligned, and means for retaining said male metal face plate and backing members securely together.

3. In combination, a steel rule male cutting and scoring die and a female counter plate as claimed in claim 1, said male metal face plate and said female counter plate being made of stainless steel.

4. A method of fabricating a steel rule male die and cooperating female counter plate comprising the steps of; laser beam cutting a series of elongated precision slots in a male metal face plate for cooperatively and securely receiving steel rule die cutting and scoring members, inserting steel rule cutting and scoring members in said elongated slots in accordance with a predetermined pattern of a sheet material to be die cut and scored, laser beam cutting a female counter plate with a series of elongated precision slots in a metal face plate for cooperatively receiving a series of steel rule scoring members, and securing a backing plate to said counter plate to cover said elongated slots forming a back-up closure for said elongated slots in said female counter plate.

5. A method of fabricating a steel rule male die and cooperating female counter plate as claimed in claim 4, in said laser beam cutting of said plates, applying a $CO_2$ laser beam having a 250–300 microsecond pulse width at a rate of 770–2000 pulses per second and a feed rate of 0.67 inches per second with an average power of 30–100 watts using an axial flow jet stream of oxygen at a pressure of 15–65 pounds per square inch and a 2.5 inch focal lens at 10.6 micron wave lengths through a 0.020 to 0.040 inch orifice in a nozzle having its focal length at the surface of the metal plate which is being cut parallel to the nozzle in increments of from 0.001 to 0.003 inch increments in a 410 stainless steel metal plate having a thickness of from 0.62 to 0.125 inches.

6. In combination, a steel rule male cutting and scoring die and a female counter plate comprising; a male metal face plate, said metal face plate having a series of laser beam cut steel rule elongated precision slots, steel rule cutting and scoring members securely retained in said laser beam cut elongated precision slots corresponding to a predetermined pattern of sheet material to be die cut and scored, a female counter plate positioned and aligned to cooperate with said male metal face plate and steel rule cutting and scoring members, said female counter plate having a metal plate, said metal counter plate having a series of laser beam cut elongated precision slots cooperatively to receive the steel rule edge scoring members retained on said male metal face plate.

7. In combination, a steel rule male cutting and scoring die and a female counter plate as claimed in claim 6, said female counter plate being constructed of high carbon tool steel and having laser beam cut elongated precision indentations therein for cooperatively receiving and retaining the steel rule cutting and scoring members therein.

8. A method of fabricating a steel rule male die and cooperating female counter plate comprising the steps of; laser beam cutting a series of elongated precision slots in a male metal face plate for cooperatively and securely receiving steel rule die cutting and scoring members, inserting steel rule cutting and scoring members in said elongated slots in accordance with a predetermined pattern of a sheet material to be die cut and scored, laser beam cutting a female counter plate with a series of elongated precision indentations in a high carbon tool steel counter plate for cooperatively receiving a series of steel rule scoring members.

9. A method of fabricating a steel rule male die and cooperating female counter plate as claimed in claim 8, in said laser beam cutting of said male metal face plate, applying a $CO_2$ laser beam having a 250–300 microsecond pulse width at a rate of 770–2000 pulses per second and a feed rate of 0.67 inches per second with an average power of 30–100 watts using an axial flow jet stream of oxygen at a pressure of 15–65 pounds per square inch and a 2.5 inch focal lens at 10.6 micron wave lengths through a 0.020 to 0.040 inch orifice in a nozzle having its focal length at the surface of the metal plate which is being cut parallel to the nozzle in increments of from 0.001 to 0.003 inch increments in a 410 stainless steel metal plate having a thickness of from .062 to 0.125 inches, and in said laser beam cutting of said high carbon tool steel female counter plate, applying $CO_2$ laser beam having a pulse length of one millisecond, at a rate of 255 pulses per second at a 2.5 inch focal lens with a 10.6 micron wave length and 90 to 120 watts average power using an axial flow jet stream of oxygen at a pressure of 15 pounds per square inch.

* * * * *